United States Patent [19]

Wetzel

[11] 3,997,006

[45] Dec. 14, 1976

[54] WELL TOOL HAVING AN HYDRAULICALLY RELEASABLE COUPLER COMPONENT

[75] Inventor: Rodney J. Wetzel, St. Martinville, La.

[73] Assignee: Hydraulic Workovers, Inc., Houma, La.

[22] Filed: Dec. 20, 1974

[21] Appl. No.: 534,757

[52] U.S. Cl. ..... 166/315; 166/114; 166/227

[51] Int. Cl.[2] ..... E21B 43/08; E21B 23/00

[58] Field of Search ..... 166/51, 114, 153, 155, 166/156, 205, 227, 276, 278, 315, 290; 285/18

[56] References Cited

UNITED STATES PATENTS

| | | | |
|---|---|---|---|
| 2,921,802 | 1/1960 | Canner | 285/18 |
| 2,927,640 | 3/1960 | Kenneday | 166/205 |
| 3,062,284 | 11/1962 | Brown | 166/51 |
| 3,710,862 | 1/1973 | Young et al. | 166/278 |
| 3,726,343 | 4/1973 | Davis | 166/278 |
| 3,901,318 | 8/1975 | Fortenberry | 166/278 |

FOREIGN PATENTS OR APPLICATIONS

| | | | |
|---|---|---|---|
| 649,462 | 10/1962 | Canada | 166/51 |

*Primary Examiner*—James A. Leppink
*Attorney, Agent, or Firm*—William C. Norvell, Jr.

[57] ABSTRACT

A well tool having an hydraulically releasable coupler component, a gravel packing apparatus and method for use therewith in a subterranean well having production tubing inserted therein, wherein said coupler comprises hydraulic means for releasing the tubing from the gravel pack apparatus without rotating said tubing when the coupler is activated and the tubing removed, the lower portion of the coupler remaining in the well with the gravel pack and providing a receptacle for a packing element partially inserted therethrough.

20 Claims, 8 Drawing Figures

B
4
3
2
1
5
12
7
8
20
6
6b
10a
22
6a
21
14
43
37
40
29
25
24
13
36
15
23
42
41
100
10
28
27a
27
26
44a
44
19
39
30
9
45a
45
31
46a
46
47
47a
17
32
33
34
16
18
C

WELL TOOL HAVING AN HYDRAULICALLY RELEASABLE COUPLER COMPONENT

BACKGROUND OF THE INVENTION

1. Field of the invention

The present invention relates to a gravel pack apparatus and a tool which may be used therewith within a subterranean well through production tubing and method utilizing said apparatus and tool. The present invention has particular utility when utilized with remedial continuous tubing.

2. Description of the prior art

In the production of fluid hydrocarbons such as oil and gas from a producing well, sand flowing into the well bore from unconsolidated formations may cause serious problems. For example, production of sand with the flow of the hydrocarbons will cause the well bore to gradually fill up with minute sand particles until production perforations in the casing, and oftentimes, the end of production tubing inserted therein are covered, the sand production resulting in holes being cut in the tubing and flow lines.

One well-known means of controlling flow of sand into the well bore is the placement of gravel on the exterior of a exterior of a slotted or perforated liner to filter sand produced with the oil or gas and thus prevent its entry into the production tubing. The liner or screen must be designed to prevent entry of gravel itself into the production tubing. This flow control means often is conducted during completion or a workover of a well after the removal of the production tubing. In the case of a gravel packing operation which is conducted on a producing well, it may be desirable, in order to reduce cost and save time, to gravel pack through production tubing. This procedure will eliminate the costly and time consuming operation of removal of the production tubing from the well, displacement of well fluids, and the like. This is of particular importance if the well is located at an offshore location or in a dual well wherein one production string remains in operation to produce the formation while a second string is utilized as a conduit for a gravel pack operation in either an upper or lower production zone.

It is, therefore, an object of the present invention to provide an apparatus for gravel packing through production tubing, utilizing remedial tubing inserted therethrough.

It is also an object of the present invention to provide a means for hydraulically releasing the remedial tubing from the gravel pack apparatus without the requirement of remedial tubular rotation or reciprocation.

It is also an object of the present invention to provide an hydraulically releasable tubing coupler having a receiving member for subsequent insertion of a component carrying a packing element.

Other objects and advantages of the present invention will be apparent from a reading of the FIGS., the specification below, and the claims.

SUMMARY OF THE INVENTION

The present invention provides, in one aspect, an apparatus for gravel packing and producing a production zone in a subterranean well through production tubing inserted therein, at least a portion of said apparatus being inserted into the well through the production tubing and activated utilizing remedial tubing inserted through said production tubing, said apparatus comprising an hydraulically releasable tubing coupler affixed to the lower end of said remedial tubing for selective disengagement of the remedial tubing from the apparatus and having a member defining a receptacle for receipt of a member having a packer, a liner assembly depending from said hydraulically releasable coupler, said liner assembly having a perforated or screen member for transmission of fluid from the well through the liner assembly, said liner assembly being lowerable into the well with the hydraulically releasable coupler, and a tubular member having a packing element, said tubular member being at least partially insertable within said receptacle member of said hydraulically releasable coupler.

In another aspect of the present invention there is provided an hydraulically releasable tubing coupler carriable by remedial tubing for separating said tubing from equipment in a subterranean well, said coupler comprising upper and lower housing members, means for selective retention of hydraulic pressure within said coupler for activation thereof, a collet member having a flexible portion, and an elongated sleeve member, said flexible portion initially being in position to prevent relative longitudinal movement between said housing members and said elongated sleeve member. The coupler has particular utility for use in the gravel pack aspect of the invention.

In still another aspect of the invention there is provided a method of gravel packing a subterranean well utilizing the apparatus and coupler herein described.

DESCRIPTION OF THE PREFERRED EMBODIMENTS

Although the present apparatus may be utilized in conjunction with conventional and threaded tubing, its design renders it ideal and extremely compatable for use with coiled tubing. In the past, conventional "snubbing" or hydraulic workover units have been utilized which have threaded or coupled tubing normally inserted through production tubing for use in various remedial operations. In recent years, continuous coiled tubing and injector units for use therewith have contributed substantially to alleviating many of the disadvantages normally associated with conventional tubing operations. For example, coiled tubing, being continuous, can be inserted into the well faster than threaded and coupled tubing which is threaded in short sections which must be screwed together. In addition, it is easier, when required, to pass continuous tubing through stuffing boxes and blowout preventers because its outer diameter is consistently the same size and is not interrupted by couplings.

Referring to the FIGS., the gravel pack apparatus of the present invention is basically comprised of an hydraulically releasable coupler A initially connected to remedial tubing B, a liner assembly C depending from the lower exterior of the hydraulically releasable coupler A, and a member D carrying a packer, said member being subsequently inserted within a portion of the hydraulic release tool A.

Figures 4A, 4B:
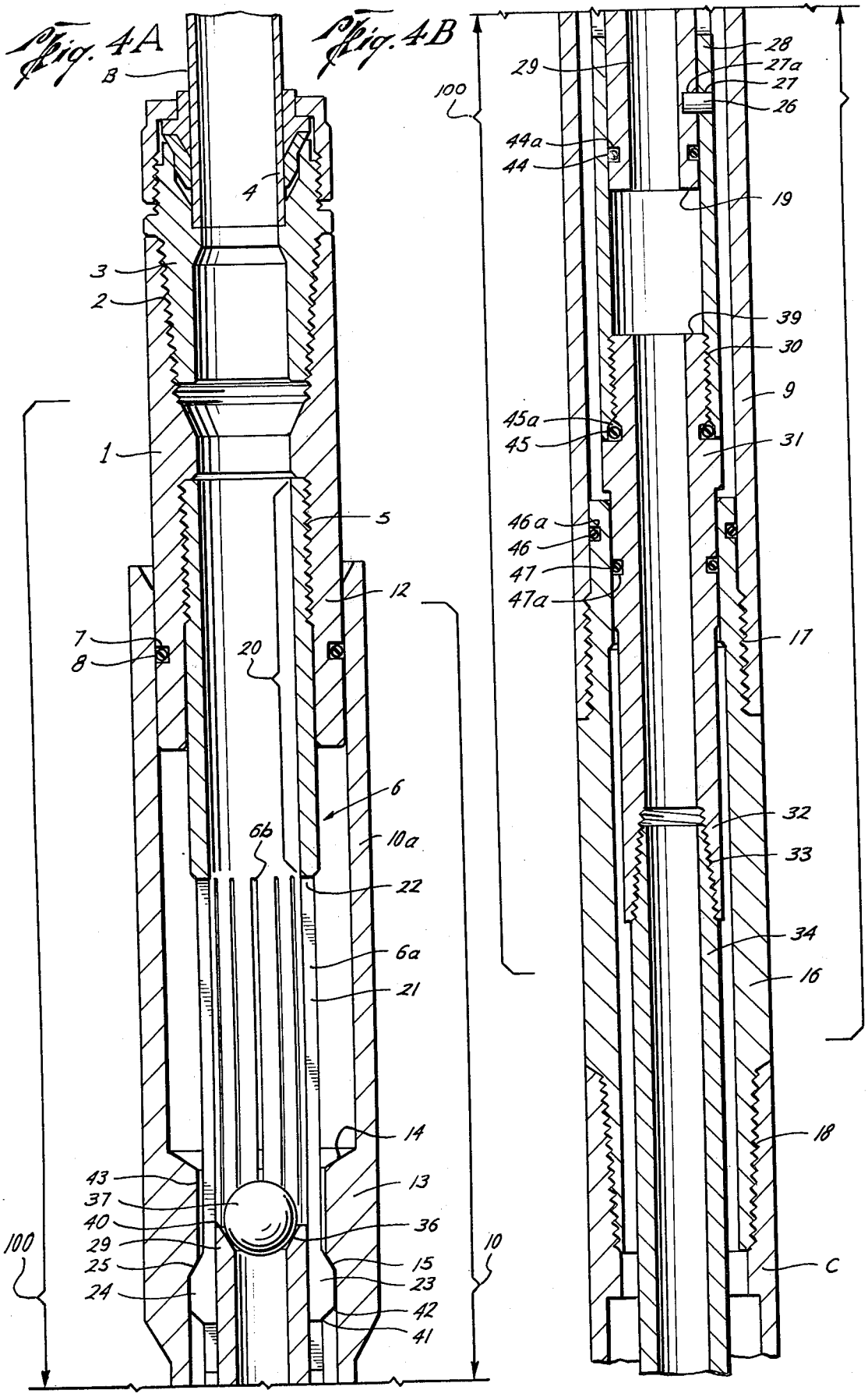
FIGS. 4A and 4B are elongated sectional views of the hydraulically releasable coupler, FIG. 4B being a lower continuation of the view of FIG. 4A.

Referring particularly to FIGS. 4A and 4B, the hydraulically releasable coupler A which is formed by inner and outer housing members 100 and 10 has tapered self-sealing female threads 2 for initial connection of the coupler A to a connector 3 by conventional means. The top sub 1 of the coupler A, in turn, has lower internally facing thread members 5 for connection of a sleeve member 6 described hereinafter. The exterior of the lower portion 12 of the top sub 1 has an encircling groove 7 for insertion therein of an O-ring 8 to prevent fluid communication between the interior of the tool A and the exterior thereof. Adjacent to the lower exterior of the top sub 1 is the upper portion 10*a* of outer housing 10 extending longitudinally from the lower portion of the top sub 1. The upper portion 10*a* of the outer housing 10 has a larger internal diameter than the internal diameter of the lower portion 12 of the top sub 1. The enlarged internal diameter thus described provides a more accessible receptacle for the packer member D when it is inserted within the upper housing portion 10*a* during the precedure described below.

The outer housing 10 also has an inwardly protruding shoulder 13 with an upwardly facing slanted surface 14 for prevention of further lower travel of the packer member D when it is inserted within the housing portion 10*a*. At the base of shoulder 13 is a downwardly facing slanted surface 15 for receipt of the finger 21 of the flexible sleeve member 6.

The outer housing 10 continues longitudinally and terminates in a bottom sub 16 which, in turn, provides threads 17 for connection of the sub 16 to the central housing member 9, and and provides threads 18 at the lower end thereof for connection to the liner assembly C depending lowerly therefrom.

Within the outer housing 10 and attached by conventional means, such as by threads 5 or the like to the top sub 1 is an elongated sleeve 6 with a collect member 6*a* formed integrally in its central portion. The sleeve 6 has an upper cylindrical portion 20, fingers 21 formed by slots ending at point 22 with a lower external abutment 23 on a spoon 24, and an upwardly facing shoulder 25 for normal eengagement with the surface 15 on the central housing member 9. The collect member 6*a* shown in the FIGS. is formed by elongated milling slots 6*b* around each finger 21.

Below the finger members 21 is shearable pin 26 housed within its receptacle 27 on the lower member 28 of the collet 6*a*, the pin 26 having a predetermined shear strength for selectively holding in place a circumferentially extending ball seat 29. The lower member 28 of the collect 6a is connected, such as by threads 30, to an internal connector 31, which, in turn, is affixed at its lower end 32 by means, such as threads 33, to a stinger member 34 which is normally but removably inserted within the liner assembly C.

The ball seat 29 provides a receiving groove 27*a* for housing the portion of the shearable pin 26 protruding interiorally from the lower member 28. The upper end of the seat 29 is beveled to form a sealing surface 36 for receipt of a ball 37. As described in proper operating sequence below, upon seating of the ball 37 on the receptacle 36, pressure will be applied within the tubing B at the top of the well, until sufficient downward force is obtained, which will be at least equal to the force necessary to shear the pin 26. When the shear pressure is achieved, the pin 26 will break, allowing the ball seat 29 to travel downwardly within the collect member 6*a* until the lower end 19 encounters the upper end 39 of the connector 31. After the upper end 40 of the ball seat 29 slides below the lower end 41 of the spoon 24, the extended fingers 21 will be cammed inwardly and collapsed into retracted mode when the tubing is raised so that the external longitudinal surface 42 of the spoon 24 will slide past the internal longitudinal surface 43 of the inwardly protruding surface 13 of the outer housing 10, when the tubing B is raised. O-rings 44, 45, 46 and 47 are provided within their respective grooves 44*a*, 45*a*, 46*a* and 47*a* to prevent fluid communication between adjacent parts.

The hydraulically releasable coupler A terminates in an elongated stinger member 34 for receipt within a receptacle 50 within the liner assembly C. The stinger 34 preferably is a length of tubing which will serve as a fluid conduit. The lower end 49 of the stinger 34 is stabbed within a circumferentially extending receptacle 50 on the liner assembly C having an inner diameter just slightly larger than the outer diameter of the stinger 34. The receptacle 50 has a groove 51 for housing a circumferentially extending o-ring seal 52 which will prevent upward passage of fluid between the i.d. of the receptacle 50 and the o.d. of the stinger 34.

The liner assembly C depends from and is a lower extension of the release tool A thereabove. The assembly C comprises a length of blank tubing 53 the upper end of which is affixed, such as by threads 18, to the lower end of the bottom sub 16 of the release tool A, and the lower end of which is affixed to or contains a perforated section or screen 55 for communication of fluid between the interior 56 of the liner assembly C above the receptacle 50 and the exterior of the liner assembly C. Although the perforated section 55 will permit fluid communication as described above, its construction is such that particulate matter, such as sand and gravel, will not flow with the fluid hydrocarbons through the section 55.

Also on the liner assembly C and below the perforated section 55 is the internally and circumferentially extending receptacle 50 for receipt of the lower end 49 of the stinger 34. The receptacle 50 has a smaller internal diameter than the portion of the liner assembly C thereabove for proper engagement of the lower end of the stinger 34.

Figure 1:
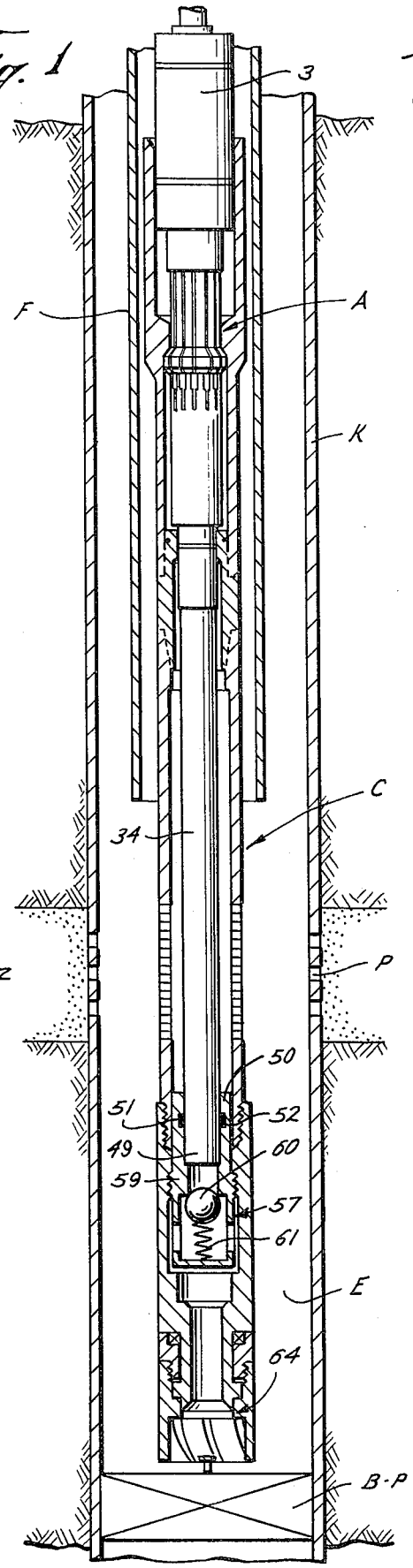
FIG. 1 is a vertical sectional view showing the hydraulically releasable coupler and the liner assembly within the well.
Figure 2:
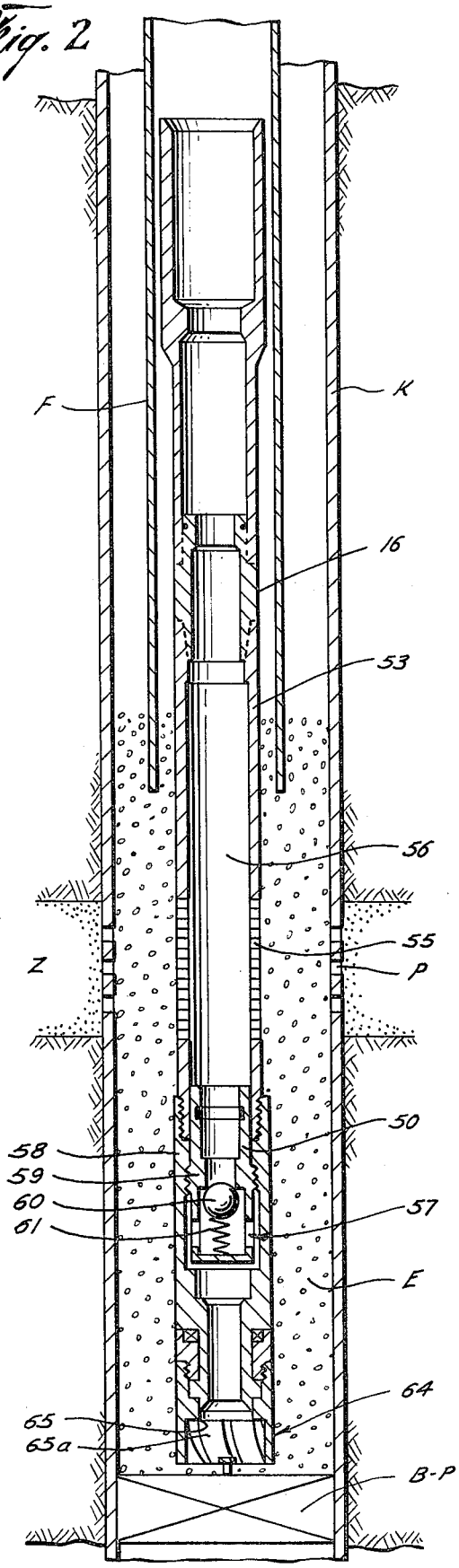
FIG. 2 is a similar view of the tool shown in FIG. 1 after insertion of gravel into the well, with the upper portion thereof released and removed from the well, the depicted portion thereof being that portion remaining in the well after said release.

Forming the lowermost end of the liner assembly C is a valve assembly 57 communicating with the stinger 34 when the stinger 34 is within the liner assembly C and its lower end is engaged within the receptable 50. The valve 57 permits fluid to travel through and out the stinger 34 and thence to the exterior of the liner assembly C, but prevents fluid within the well bore E to enter therethrough. As shown in FIGS. 1 and 2, the valve assembly 57 basically comprises a housing 58 having therein a seealing receptacle 59 for a ball member 60, the interior of the receptacle 59 providing the upper portion of a fluid passageway between the stinger 34 and the lower portion of the valve 57. The ball 60 is held in sealing engagement on the lower end of the receptacle 59 and when pressure is not exerted within the tubing B, by means of an expanded but compressible spring element 61.

Below the valve assembly 57 and attached to the housing 58 is a blade member 64 rotated by fluid flow and having a plurality of blade elements 65, the spaces 65a between the blades 65 serving as passageways for fluid between the blade members 64 and the housing 58. The grooves or passageways 65a operate in combination with the blade elements 65 upon increase of pressure in the tubing B from the lower end of the liner assembly C in a forceful jet action such that sand and other particulate matter below the liner assembly C in the well bore E are washed away from the lowerly moving liner assembly C therethrough and the length of gravel pack being constantly agitated thereby. Typical of such a valve assembly 57 is the Turbo Jet Shoe depicted in FIG. 16, page 131, of the Oil Well Screen Catalog No. 164 of Howard Smith Company, Houston, Texas.

Figure 3:
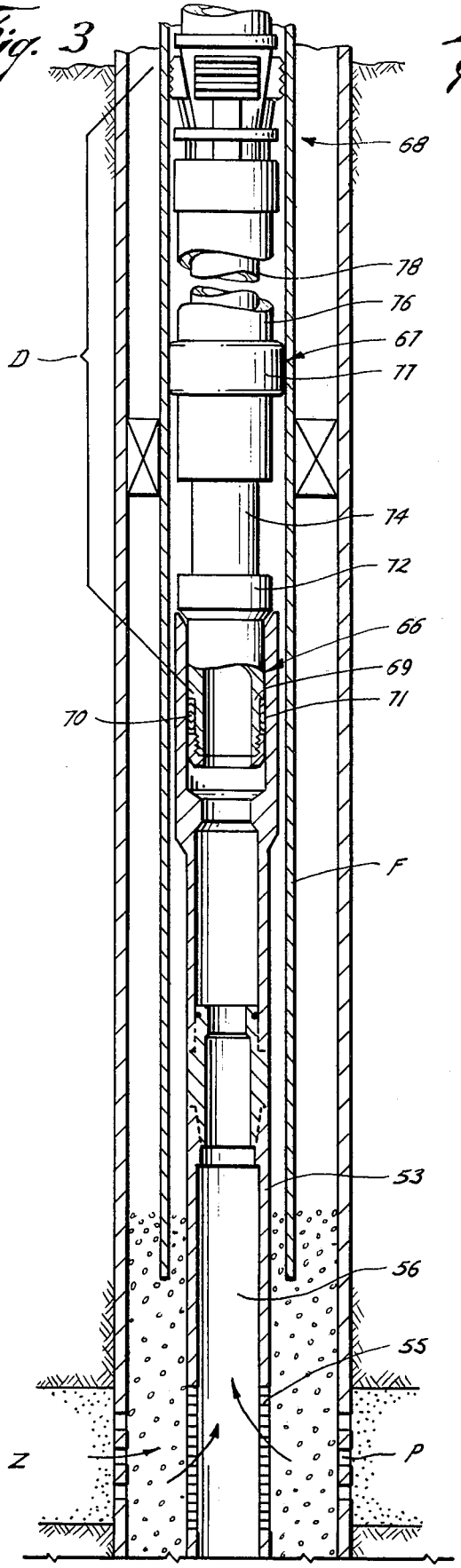
FIG. 3 is a view similar to those shown in FIGS. 1 and 2 and showing the well packer in place and the well being produced through the gravel packing elements.
Figure 5:
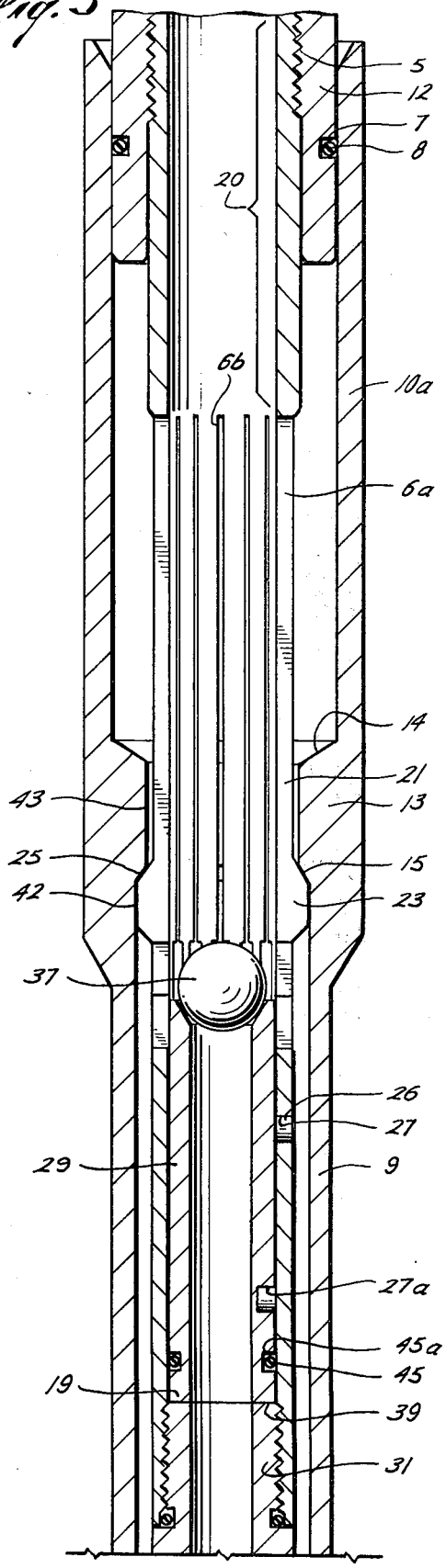
FIG. 5 is a sectional schematic drawing of a portion of the coupler after hydraulic activation.

The packing assembly D may be of any conventional and known design for utilization in production tubing, and may be lowered into the well and set by wire line or other similar means. For example, a modified "K-3" Straddle Pack-Off, Product No. 819-55 of Baker Oil Tools, Inc., Houston, Texas, may be utilized. This tool is depicted on page 446 of the 1974–75 Catalog of Baker Oil Tools, Inc. Referring to FIG. 3, the packing assembly D basically comprises a landing shoe assembly 66, a pack off assembly 67 thereabove, and is terminated at its upper end by a tubing stop mechanism or anchor 68.

The landing shoe assembly 66 of the packer member D has an elongated tubular housing 69 with a series of chevron shaped elastomeric seal members 70 for sealing engagement with the inner smooth bore 71 of the upper portion 10*a* of the outer housing 10 of the release tool A. A shoulder 72 is extendably provided for engagement with the top of the housing 10*a*, which serves as a receptacle. The housing 69 of the landing shoe 66 is connected, such as by threads to a blank tubing section 74, which, in turn, is connected at its upper end to the main pack off assembly 67. The pack off assembly 67 is of conventional design and basically comprises a cylindrical housing 76 with a protruding and expandable packing element 77 therein on an elongated mandrel 78, the mandrel being movable downwardly by wire line mechanism to cause expansion of the packing element 77 into sealing engagement with the interior of the production tubing F to prevent production of hydrocarbons through the annular area between the liner assembly C and the production tubing F.

Figure 6:
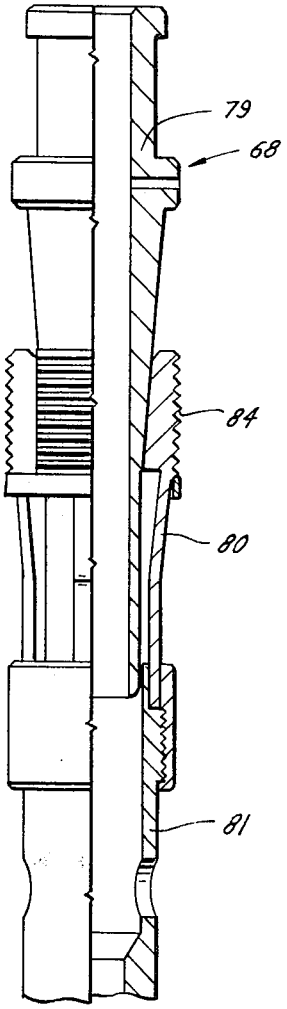
FIGS. 6 and 7 are enlarged sectional drawings of the tubing anchoring mechanism of the gravel packing apparatus shown in FIG. 3, FIG. 6 showing the mechanism prior to activation and FIG. 7 showing said mechanism in extended or activated mode within the production tubing.
Figure 7:
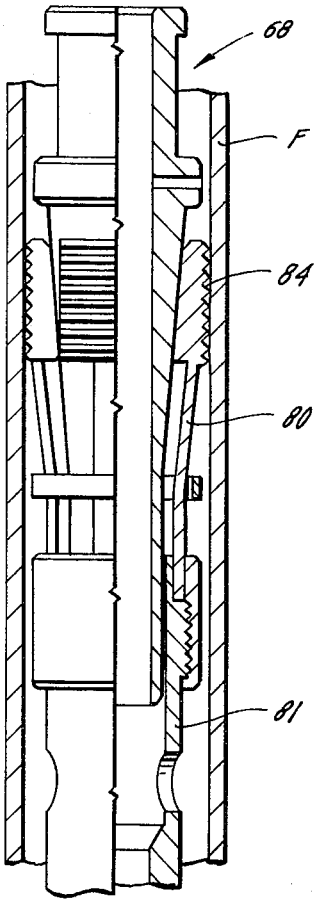

A tubing stop or anchor mechanism 68 is landed by wire line within the interior of the upper portion of the housing 76 of the pack off assembly 67. As shown in detail in FIGS. 6 and 7, the anchor 68 is provided at its upper end with a cylindrical cone shaped expander member 79 for engagement with a series of longitudinally cut slip elements 80 depending from a lower slip carrier 81. As the expander 79 is moved downwardly within the slips 80 by wire line mechanism, the cone shape of the expander 79 will cause the slips to separate and expand until they come into anchoring engagement with the inner wall of the tubing F by means of engagement of the teeth 84.

OPERATION

It is understood that the lower portion of the production zone Z is either the bottom of the well or a bridge plug B–P has been set to serve as a reference point and to prevent the subsequently placed gravel from being placed below the production zone Z. The upper portion of the zone may be sealed off between the casing K and the production tubing F by means of a packer shown in the drawings by an X configuration. The casing K will have perforations P extending longitudinally and circumferentially within the area of the production zone Z.

In order to clean out the well bore E and to remove contaminating fluids, the remedial tubing B is run into the well within the production tubing F, and an aqueous solution, preferably brine, is circulated down the remedial tubing B through the bore E within the zone Z and through the perforations P, thence upwardly within the remedial tubing - production tubing annulus to the top of the well for treatment and recirculation or for disposal. Reverse circulation also may be conducted. Thereafter the remedial tubing B is removed from the well and gravel within a fluid such as brine or other aqueous or acidic solution is pumped through the production tubing F to the zone Z and deposited therein until the perforations P are covered.

After the gravel pack is within the zone Z and above the perforations P, the liner assembly C and the release tool A thereabove are lowered into the well on the remedial tubing B. The liner assembly C is washed into place through the gravel pack as the result of the strong agitation of the gravel particles when fluid is pumped through the tubing B. As the liner assembly C is washed into place, and at a known and determinable depth reached by the end of the liner assembly C in the bore E, the ball 37 is pumped or allowed to gravitate within the remedial tubing B for landing on the beveled seal surface 36 on the ball seat 29 of the release tool A. As pumping of fluid in the tubing B continues, pressure therein will increase because of the sealing engagement of the ball 37 on the surface 36 until the pin 26 is sheared. When the pin 26 shears, the ball seat 29 will move downwardly within theh housing 10 until resistance is afforded by contact of the lower end 19 of the seat 29 with the upper and inwardly protruding end 39 of the connector 31. As the upper end 40 of the ball seat 29 passes below the lower end of the spoon 24 on the fingers 21 of the collect 6a, the fingers 21 may flex inwardly when the tubing B is raised, such that the lower external abutment 23 on the collet 6*a* may subsequently slide upwardly within the internal diameter of the housing 10 and thence upwardly within the production tubing F.

After the pin 26 has been sheared and the fingers 21 contracted, the removable portion of the release tool A (inner housing 100) comprising the top sub 1, the sleeve 6, the ball 37, the seat 29, the internal connector 31 and the stinger 34 are removed from the well on the remedial tubing B.

Thereafter, the landing shoe assembly 66 carried below the pack off assembly 67 is lowered as a unit along with the assembly 67 into the well by wire line through the housing 10*a* which now serves as a receptacle for the packing assembly D, until the shoulder 72 of the landing shoe 66 encounters the top of housing 10*a* and the seal members 70 on the housing 69 of the landing shoe assembly 66 are in sealing engagement within the bore 71. The mandrel 78 is activated by wire line and is moved downwardly to cause sealing expansion of the packing element 77. Thereafter, the anchor element 68 is lowered into the well on a wire line and placed within the pack off assembly 67. The cone shaped expander mandrel 79 of the anchor element 68 is urged within the slip elements 80 to cause them to expand and anchor within the production tubing F by means of the teeth 84 grasping the inner wall of the tubing F.

When the pack off is completed as describd above, the zone is produced through the perforations P, thence through the screen or perforated member 55 in the liner assembly C and upwardly through the packer member D and the production tubing F to the top of the well.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What I claim and desire to secure by Letters Patent is:

1. An apparatus for gravel packing and producing a production zone in a subterranean well through production tubing inserted therein, at least a portion of said apparatus being inserted into the well through the production tubing and activated utilizing remedial tubing inserted through said production tubing, said apparatus comprising: an hydraulically releasable coupler affixed to the lower end of said remedial tubing for selective disengagement of the remedial tubing from the apparatus and having a member defining a receptacle for receipt of a member having a packer, a liner assembly depending from said hydraulically releasable coupler, said liner assembly being lowerable into the well with the hydraulically releasable coupler, and a tubular member in association with said remedial tubing having a packing element, said tubular member being at least partially insertable within said receptacle member of said hydraulically releasable coupler.

2. The apparatus of claim 1 wherein the hydraulically releasable coupler comprises a housing, means for selective rentention of hydraulic pressure within said coupler for activation thereof, a collet member having at least one flexible element, and an elongated sleeve member, said flexible element initially being in position to prevent relative longitudinal movement between said housing and said collet member, and said elongated sleeve member locking said flexible element in said position.

3. The apparatus of claim 1 wherein the hydraulically releasable coupler comprises a housing, means for selective retention of hydraulic pressure within said coupler for activation thereof, a collet member having at least one flexible element, said collet member being within said housing, an elongated sleeve member selectively movable longitudinally along a portion of said collet and being releasably connected to said collet, said flexible element initially being in position to prevent relative longitudinal movement between said housing and said collet member, and said elongated sleeve member locking said flexible element in said position.

4. The apparatus of claim 1 wherein the hydraulically releasable coupler comprises inner and outer tubular housing members, means for selective retention of hydraulic pressure within said coupler for activation thereof, a collet member having a flexible portion, said collet member being connected to one of said inner and outer tubular housing members and in engagement with the other of said inner and outer tubular housing members, an elongated sleeve member fixed to said collet member and being selectively movable thereon, said flexible portion initially being in position to prevent relative longitudinal movement between said inner and outer tubular housing members.

5. The apparatus of claim 1 wherein the hydraulically releasable coupler comprises inner and outer tubular housing members, a collet member having a flexible portion, said collet member being connected to one of said inner and outer tubular housing members and in engagement with the other of said inner and outer tubular housing members, an elongated sleeve member fixed to said collet member and being selectively movable thereon, said flexible portion initially being in position to prevent relative longitudinal movement between said inner and outer tubular housing members, said elongated sleeve member having means defining a ball seat for receipt of a ball element for prevention of downward fluid transmission through said apparatus.

6. The apparatus of claim 1 wherein the hydraulically releasable coupler comprises inner and outer tubular housing members, means for selective retention of hydraulic pressure within said coupler for activation thereof, a collet member having a flexible portion, said collet member being connected to one of said inner and outer tubular housing members and in engagement with the other of saaid inner and outer tubular housing members, an elongated sleeve member fixed to said collet member and being selectively movable thereon, said flexible portion initially being in position to prevent relative longitudinal movement between said inner and outer tubular housing members, said outer housing member being removable from said inner housing member.

7. The apparatus of claim 1 wherein the hydraulically releasable coupler comprises inner and outer tubular housing members, means for selective retention of hydraulic pressure within said coupler for activation thereof, a collet member having a flexible portion, said collet member being connected to one of said inner and outer tubular housing members and in engagement with the other of said inner and outer tubular housing members, an elongated sleeve member fixed to said collet member and being selectively movable thereon, said flexible portion initially being in position to prevent relative longitudinal movement between said inner and outer tubular housing members, said inner housing being removable from said outer housing to the top of the well.

8. The apparatus of claim 1 wherein the hydraulically releasable coupler comprises inner and outer tubular housing members, means for selective retention of hydraulic pressure within said coupler for activation thereof, a collet member having a flexible portion, said collet member being connected to one of said inner and outer tubular housing members and in engagement with the other of said inner and outer tubular housing members, an elongated sleeve member fixed to said collet member and being selectively movable thereon, said flexible portion initially being in position to prevent relative longitudinal movement between said inner and outer tubular housing members, and tubular means carried by said inner housing member for insertion within said liner assembly for transmission of fluid within said remedial tubing through said liner assembly and out of the lower end thereof.

9. The apparatus of claim 1 wherein the hydraulically releasable coupler comprises inner and outer tubular housing members, means for selective retention of hydraulic pressure within said coupler for activation thereof, a collet member having a flexible portion, said collet member being connected to one of said inner and outer tubular housing members and in engagement with the other of said inner and outer tubular housing members, an elongated sleeve member fixed to said collet member and being selectively movable thereon, said flexible portion initially being in position to prevent relative longitudinal movement between said inner and outer tubular housing members, and tubular means carried by said inner housing member for insertion within said liner assembly for transmission of fluid within said remedial tubing through said liner assembly and out of the lower end thereof, said inner housing, said collet, said sleeve and said tubular means being removable from said outer housing member to the top of the well.

10. The apparatus of claim 1 wherein the hydraulically releasable coupler comprises inner and outer tubular housing members, means for selective retention of hydraulic pressure within said coupler for activation thereof, a collet member having a flexible portion, said collet member being connected to one of said inner and outer tubular housing members and in engagement with the other of said inner and outer tubular housing members, an elongated sleeve member fixed to said collet member and being selectively movable thereon, said flexible portion initially being in position to prevent relative longitudinal movement between said inner and outer tubular housing members, and wherein the member defining a receptacle for a member carrying a packer is one of the inner and outer tubular housing members.

11. The apparatus of claim 1 wherein the hydraulically releasable coupler comprises inner and outer tubular housing members, means for selective retention of hydraulic pressure within said coupler for activation thereof, a collet member having a flexible portion, said collet member being connected to one of said inner and outer tubular housing members and in engagemet with the other of said inner and outer tubular housing members, an elongated sleeve member fixed to said collet member and being selectively movable thereon, said flexible portion initially being in locked position to prevent relative longitudinal movement between said inner and outer tubular housing members, and wherein the member defining the receptacle is the outer tubular housing member.

12. The apparatus of claim 1 further comprising a check valve assembly carried by said liner assembly, said valve assembly permitting downward flow of fluid therethrough but preventing upward flow of fluid therethrough.

13. The apparatus of claim 1 further comprising tubular means carried by said hydraulically releasable coupler for insertion within said liner assembly for transmission of fluid within said remedial tubing through said liner assembly and out of the lower end thereof, means carried by said liner assembly for sealing engagement with the lower exterior of said tubular means, and a check valve assembly carried by said liner, said check valve assembly permitting downward flow of fluid therethrough but preventing upward flow of fluid therethrough, the interior of said valve assembly being communicable with the interior of said tubular means.

14. The apparatus of claim 1 further comprising tubular means carried by said hydraulically releasable coupler for insertion within said liner assembly for transmission of fluid within said remedial tubing through said liner assembly and out of the lower end thereof, means carried by said liner assembly for sealing engagement with the lower exterior of said tubular means, a check valve assembly carried by said liner permitting downward flow of fluid therethrough from the interior of said tubular means but preventing upward flow of fluid therethrough, and a rotatable element depending from said valve assembly, said rotatable element having a plurality of arched fluid passageways for forceful ejection of fluid into the well upon rotation of said element.

15. The apparatus of claim 1 wherein said tubular member having a packing element comprises sealing means for sealingly landing the lower end of said tubular member within one of the inner and outer housing members of the hydraulically releasable coupler, a packer for sealing within the interior of the production tubing, and means for anchoring said apparatus in said well.

16. An apparatus for gravel packing and producing a production zone in a subterranean well through production tubing inserted therein, at least a portion of said apparatus being inserted into the well through the production tubing and activated utilizing remedial continuous tubing inserted through said production tubing, said apparatus comprising: an hydraulically releasable coupler affixed to the lower end of said remedial continuous tubing for selective disengagement of the remedial continuous tubing from the apparatus and having a member defining a receptacle for receipt of a member having a packer, a liner assembly depending from said hydraulically releasable coupler, said liner assembly having a perforated member for transmission of fluid from the well through the liner assembly, said liner assembly being lowerable into the well with the hydraulically releasable coupler, and a tubular member having a packing element, said tubular member being at least partially insertable within said receptacle member of said hydraulically releasable coupler.

17. The apparatus of claim 16 wherein the hydraulically releasable coupler comprises inner and outer tubular housing members, means for selective retention of hydraulic pressure within said coupler for activation thereof, a collet member having a flexible portion, said collet member being connected to one of said inner and outer tubular housing members and in engagement with the other of said inner and outer tubular housing members, and an elongated sleeve member fixed to said collet member and being selectively movable thereon, said flexible portion initially being in position to prevent relative longitudinal movement between said inner and outer tubular housing members.

18. A method of gravel packing a production zone in a subterranean well through production tubing inserted therein comprising the steps of:

a. Inserting remedial tubing through said production tubing;

b. Flushing said production zone with fluid pumped to said zone through one of said production tubing and said remedial tubing, thence to the top of the well to the other of said production tubing and said remedial tubing;

c. Providing a gravel pack around a perforated liner run on said remedial tubing by placing gravel in said zone upon circulating fluid containing said gravel in said zone, and circulating said fluid to the top of the well to said remedial tubing;

d. Hydraulically releasing said remedial tubing from said liner assembly;

e. Removing said remedial tubing to the top of the well; and f. Rerunning said remedial tubing within the production tubing, said remedial tubing having affixed on its lowered end a tubular member having a packing element to provide a packoff above the gravel pack between the production tubing and the remedial tubing.

19. A method of gravel packing a production zone in a subterranean well through production tubing inserted therein comprising the steps of:

a. Inserting remedial tubing through said production tubing;

b. Flushing said production zone with fluid pumped to said zone through one of said production tubing and said remedial tubing thence to the top of the well through the other of said production tubing and said remedial tubing;

c. Providing a gravel pack around a perforated liner run on said remedial tubing by placing gravel in said zone upon circulating fluid containing said gravel down the production tubing, disposing said gravel in said zone, and circulating said fluid to the top of the well through said remedial tubing, said remedial tubing having affixed to its lower end prior to placing gravel an apparatus comprising an hydraulically releasable coupler for selective disengagement of the remedial tubing from the apparatus and having a member defining a receptacle for receipt of a member having a packer, a liner assembly depending from said hydraulically releasable coupler, said liner assembly having a perforated member for transmission of fluid from the well through the liner assembly, said liner assembly being lowerable into the well with the hydraulically releasable coupler;

d. Hydraulically releasing said remedial tubing from said liner assembly;

e. Removing said remedial tubing to the top of the well; and f. Rerunning said remedial tubing within the production tubing, said remedial tubing having affixed on its lowered end a tubular member haaving a packing element to provide a pack off above the gravel pack between the production tubing and the remedial tubing, said tubular member being at least partially insertable within said receptacle member of said hydraulically releasable coupler.

20. The method of claim 19 wherein the step of hydraulically releasing said remedial tubing from said liner assembly comprises activating said hydraulically releasable coupler having inner and outer tubular housing members, means for selective retention of hydraulic pressure within said coupler for activation thereof, a collet member having a flexible portion, said collet member being connected to one of said inner and outer tubular housing members and in engagement with the other of said inner and outer tubular housing members, and an elongated sleeve member fixed to said collet member and being selectively movable thereon, said flexible portion initially being in position to prevent relative longitudinal movement between said inner and outer tubular housing members.

* * * * *